United States Patent [19]

Frank

[11] 4,232,650

[45] Nov. 11, 1980

[54] BAFFLED STOVE

[75] Inventor: Bruce A. Frank, Salt Lake City, Utah

[73] Assignee: Baffle Stove Company Inc., Salt Lake City, Utah

[21] Appl. No.: 937,966

[22] Filed: Aug. 30, 1977

[51] Int. Cl.[3] ..... F24C 1/14

[52] U.S. Cl. ..... 126/77

[58] Field of Search ..... 126/121, 120, 58, 77, 126/67; 431/10

[56] References Cited

U.S. PATENT DOCUMENTS

| | | | |
|---|---|---|---|
| 818,617 | 4/1906 | Emery | 126/77 |
| 918,823 | 4/1909 | Cahoone | 126/77 |
| 1,123,725 | 1/1915 | Putral | 126/77 |
| 1,663,937 | 3/1928 | Ehrlich | 126/77 |
| 3,104,696 | 9/1963 | Schwindeman | 431/10 |
| 3,730,668 | 5/1973 | Iida et al. | 431/10 |

*Primary Examiner*—Samuel Scott
*Assistant Examiner*—Wesley S. Ratliff, Jr.
*Attorney, Agent, or Firm*—Richard F. Bojanowski

[57] ABSTRACT

A Baffled Stove is described having a generally rectangular heating structure with its lower or bottom portion adapted to form a firebox for receiving fuel such as wood or coal. A primary air passageway is provided for introducing air into the heating structure at or near the level of the firebox. Controls are also provided to adjust the quantity of primary air introduced into the heating structure. A hinged door is mounted in the front door of the rectangular heating structure for introducing fuel into the firebox. A secondary air inlet is in communication with a conduit positioned in a plane horizontal to the firebox to provide a baffle for directing the flow of the products of combustion and also for preheating the secondary air as it passes therethrough. The preheated air exits at a point opposite to the secondary air inlet. The gases of combustion and smoke circulate circuitously through the fire chamber and comingles with the preheated secondary air as it exits from the horizontal conduit to produce additional or secondary burning. The unused air and final products of combustion are carried to the atmosphere through a flue outlet located at or near the top of the heating structure on a side opposite to the secondary air outlet.

10 Claims, 4 Drawing Figures

BAFFLED STOVE

BACKGROUND OF THE INVENTION

1. Field of the Invention

This invention is directed generally to a wood burning stove, and particularly to a stove having a pair of horizontal baffles positioned in a plane above the firebox of the stove, whereby the baffles also function as a conduit for preheating secondary air prior to being introduced into an upper zone at a point near where the secondary air exits to cause additional burning of smoke and waste gases.

2. State of the Art

With the advent of the fossil fuel shortages, the popularity of wood burning stoves has dramatically increased. Most stoves that are currently available on the open market have a burning efficiencey of under 50%. However, it is generally well known that this efficiency can be substantially increased by incorporating a secondary air source into the stove to support secondary combustion of smoke and waste gases prior to their exit to the atmosphere.

Although there are several types of stoves currently on the market which provide a secondary air source, there are none available which are capable of providing a means whereby the secondary air can be preheated to a temperature which will sustain a substantially complete combustion of the primary products of combustion within the stove, and prior to their exit to the atmosphere.

OBJECTS OF THE INVENTION

It is therefore a primary object of this invention to provide a stove capable of producing preheated secondary air for supporting secondary combustion of the primary products of combustion. Another object of this invention is to provide a stove which is capable of more efficient burning. Still another object of this invention is to provide a stove having a pair of baffle plates positioned above the firebox which also functions as a preheater for secondary air being introduced into an upper zone for supporting combustion of the smoke and gases produced during the primary burning. A final object of this invention is to provide a stove having a secondary air preheater which also functions as a baffle for causing the draft to take a circuitous path.

SUMMARY OF THE INVENTION

These and other objects of this invention are attained by a stove comprising generally a rectangular heating structure with the bottom of said structure adapted to form a firebox for receiving and burning fuel. A primary air passageway is provided for introducing air into said heating structure at the level of the firebox. A secondary air inlet source in communication with a conduit positioned horizontally over said firebox is also provided for preheating said secondary airpassing therethrough. The secondary preheated air exits through a secondary air outlet opening within the heating structure for supportiing combustion of the primary products of combustion and a flue outlet for carrying gases of the secondary combustion to the atmosphere. A hinged door fitted with a latch is also provided for introducing fuel into the firebox area. The door is preferably adapted with a glass window to view burning. The secondary air inlet comprises a vertical passageway positioned along the rear wall of the stove having an inlet opening comprising a plurality of elongated slots positioned at or near the bottom of the heating structure. A second conduit in communication with the vertical conduit is positioned above the firebox area in a plane generally horizontal thereto and having an outlet at or near the front portion of the heating structure. This arrangement provides for a very efficient heating system whereby the secondary air is heated both as it passes through the vertical and particularly through the horizontal conduit. This results in a preheated secondary air that can be easily maintained at or near a temperature in excess of 900° F. (480.2° C.) and preferably at a temperature of about 1100° F. (590.3° C.).

DETAILED DESCRIPTION OF A PREFERRED EMBODIMENT

Figure 1:
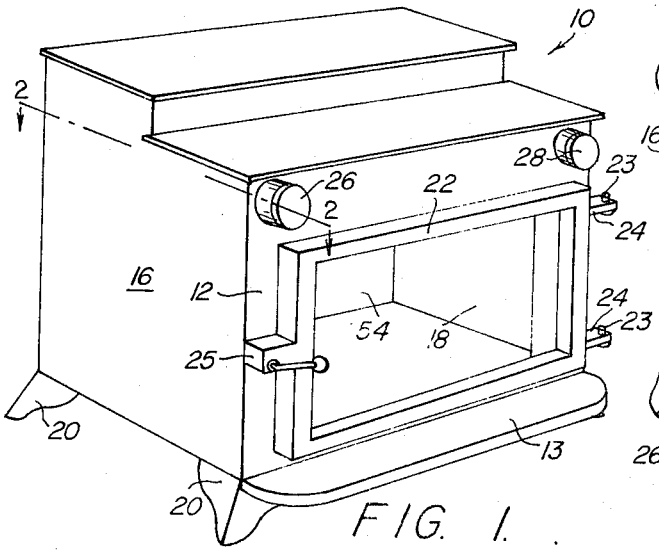
FIG. 1 is an isometric view of the stove of this invention.
Figure 2:
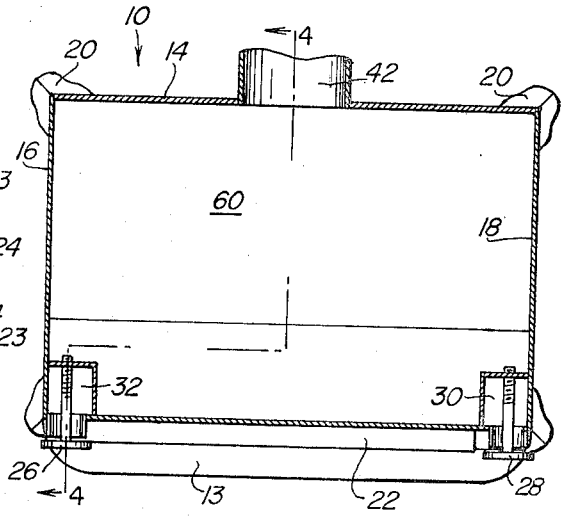
FIG. 2 is a top cross section taken along lines 2—2 of FIG. 1.
Figure 3:
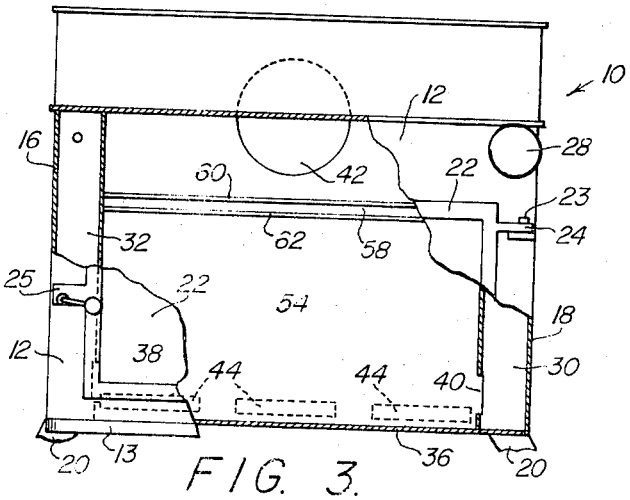
FIG. 3 is a front elevation of the stove shown in FIG. 1 with parts cut away and other parts shown in phantom.
Figure 4:
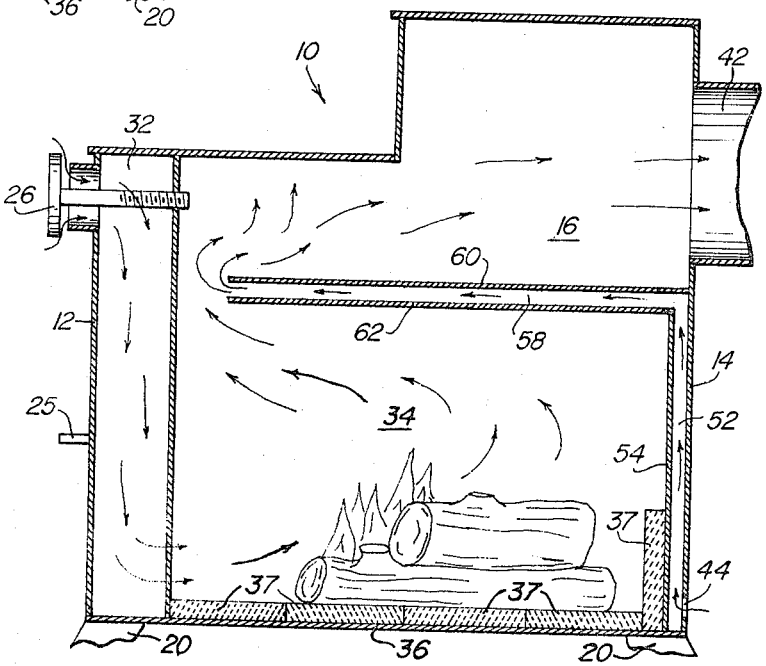
FIG. 4 is a vertical cross section taken along lines 4—4 of FIG. 2 with arrows showing the primary and secondary air flows.

Referring generally to FIG. 1 and more specifically to FIGS. 2 through 4 inclusive, the fireplace of this invention includes a generally rectangular heating structure identified by the numeral 10. The rectangular heating structure has a front wall 12, having a lower ledge or lip 13, a rear wall 14, and two side walls, 16 and 18, respectively. The rectangular heating structure is also provided with four legs 20, mounted at or near the corners of the rectangular heating structure 10. A door 22, is provided with armed hinged members 24, fixed to the rectangular heating structure by pins 23. A latch 25, is also provided for securing the door 22, in a closed position during operation. Rotatable air inlet controls, 26 and 28, are screw mounted at or near the top portion of the front panel of the heating structure for controlling the volume of air introduced therein. The air inlet openings are connected to a pair of vertical primary air conduits, 30 and 32, leading downward and opening into the firebox area 34, located on the bottom wall, 36 of the heating structure. Preferably the bottom wall is lined with fire brick, 37 or other suitable like materials capable of withstanding high temperatures. The vertical primary air conduits have an opening, 38 and 40, respectively which introduces the primary air of combustion into the firebox area, 34. A flue outlet, 42 is provided along the rear wall of the heating structure and above the horizontal conduit, 52 for carrying the smoke and unburnt secondary combustion gases to the atmosphere.

To insure that the smoke and other combustion gases are also utilized during the burning process and thereby provide a more efficient burning operation, a secondary air inlet channel is provided whereby the secondary air is preheated prior to being introduced into the interior of the heating structure. By properly preheating the secondary air, a secondary type of combustion occurs at or near the conduit's outlet whereby additional heat is generated and thereby permitting the combustion gases and the smoke generated during the primary combustion sequence to be burnt prior to entering the flue outlet. This is achieved by providing a plurality of secondary air inlets, 44 along the bottom rear wall of the heating structure. The air passes through the inlets and enters into a vertical passageway, 53 formed by a second vertical wall, 54 fixed to the heating structure's bottom wall, 36, and side walls, 16 and 18. Preferably this vertical channel has essentially the same dimensions as the heating structures back wall, 14. The conduit, 52 formed by the inner and outer back walls are in communication with a horizontal conduit, 58 formed by an upper and lower baffle plate, 60 and 62, respectively. These baffle plates are positioned in a substantially horizontal plane above the firebox, 34. This conduit or horizontal channel, 58 has essentially the same dimensions as the vertical conduit, 52 and is fixed to the side walls, 16 and 18, of the heating structure 10 to also produce an overhead baffle effect, directing the flow of heated air in a circuitous path as shown by the arrows in FIG. 4.

Preferably the volume of secondary preheated air is from about 3 to 5 times as the volume of the primary air introduced into the heating structure. In addition, the preheated secondary air passes through first a vertical conduit and then secondly through a horizontal conduit to insure maximum preheating prior to being introduced into the heating structure where secondary burning occurs. The temperature of the preheated secondary air will normally exceed 900° F. and preferably will be in a range of between about 1000° and 1300° F. At these temperatures the secondary combustion of the smoke and other effluent gases produced during the primary combustion are most likely to occur and thereby provide a zone most suitable for producing a secondary combustion. In addition, the use of the vertical baffle conduit for providing secondary air also provides a means for producing a circuitous route for the spent gases to follow before entering the flue outlet and exiting into the atmosphere.

This results in a more efficient burning process and thus provides for more efficient use of the heat generated during the primary and secondary combustion sequences.

It has been found that by utilizing a vertical and horizontal conduit for introducing preheated secondary air into the heating structure there is approximately 60 percent more energy available from the burning of wood and coal. This occurs because the preheated secondary air is introduced into the secondary burning zone at a temperature of about 1100° F. and thereby results in a more efficient burning process of the smoke and gases generated during the primary combustion phase.

As previously mentioned 3 to 5 times as much secondary air is necessary than primary air in order to effectively support the secondary combustion. This is acheived by utilizing a secondary air preheater comprising a combination of vertical and horizontal conduits having a relatively large surface area. Preferably the surface area of the secondary preheater which is exposed to heat radiation is approximately twice to three times the surface area of the stoves back wall. This surface area was calculated by adding the surface area of the top and bottom wall of the horizontal conduit to the surface area of the vertical conduit.

Although certain preferred embodiments have been illustrated and described herein above it should be understood that various changes may be made without departing from the spirit and scope of the disclosed inventive concept which is limited only by the claims appended hereto.

I claim:

1. A generally rectangular heating structure having two sides walls, a front wall, a back wall a top wall and a bottom wall wherein said bottom wall is adapted to form a firebox for receiving fuel, a primary air passageway for introducing air into said heating structure at a level near said firebox, a secondary air inlet vertical passageway wherein said passageway includes a vertical wall spaced from said back wall and fixed to said bottom wall and to said side walls and a horizontal passageway includes a pair of spaced apart horizontally positioned baffle plates sealed at their side ends to said side walls, and a flue outlet for carrying gases of combustion to the atmosphere, said vertical and horizontal passageways forming a continuous conduit whereby secondary air enters near the bottom of the vertical passageway for preheating and exits through an outlet in said horizontal passageway where said secondary air is combined with gases of combustion for secondary burning and circuitously flows outwardly through said flue outlet.

2. The rectangular heating structure of claim 1 wherein said secondary air is heated to a temperature of at least 900° F.

3. The heating structure of claim 1 wherein said primary air passageway has a controlled opening in communication with a vertical passageway having an outlet opening at a level near said firebox.

4. The rectangular heating structure of claim 3 wherein said primary air passageway is positioned at a point near the junction of the front wall and the side wall of said heating structure.

5. The rectangular heating structure of claim 4 including a second vertical conduit for carrying primary air into said heating structure, said vertical conduit being positioned at the other junction of the front and side walls of said rectangular heating structure.

6. The heating structure of claim 1 wherein the outlet of said secondary air is on the opposite side of said flue outlet.

7. The heating structure of claim 6 including a door mounted on the heating structure front wall for introducing fuel into said firebox.

8. The heating structure of claim 7 wherein said heating structure is carried on four legs mounted to each corner of said heating structure.

9. A method of burning fuel in a rectangular heating structure having a firebox area comprising introducing primary combustion air into said firebox, introducing a secondary preheated combustion air into said firebox, at a temperature in excess of 900° F. at a point where smoke and combustion gases generated during the primary combustion sequence passes prior to leaving said heating structure through a flue outlet.

10. The method of claim 9 whereby the secondary air is preheated by passing said air through a vertical channel and then into a horizontal channel positioned above said firebox level to insure that said secondary air is heated to a temperature of about 1100° F. prior to being introduced into the secondary combustion area.

* * * * *